United States Patent [19]

Guerry et al.

[11] 4,176,079

[45] Nov. 27, 1979

[54] WATER-SOLUBLE ENZYME-CONTAINING ARTICLE

[75] Inventors: Raymond E. Guerry, Forest Park; David D. Whyte, Cincinnati, both of Ohio

[73] Assignee: The Procter & Gamble Company, Cincinnati, Ohio

[21] Appl. No.: 789,323

[22] Filed: Apr. 20, 1977

[51] Int. Cl.[2] ..... C11D 17/06

[52] U.S. Cl. ..... 252/90; 252/89.1; 252/135; 252/524; 252/174; 252/542; 252/DIG. 3; 252/DIG. 12; 435/182

[58] Field of Search ..... 252/89, 90, DIG. 3, 252/DIG. 12, 174; 195/63, 68, DIG. 11

[56] References Cited

U.S. PATENT DOCUMENTS

| | | | |
|---|---|---|---|
| 3,576,760 | 4/1971 | Gould et al. | 252/403 |
| 3,767,790 | 10/1973 | Guttag | 424/81 |
| 3,775,331 | 11/1973 | Borrello | 252/89 |
| 3,784,476 | 1/1974 | van Kampen et al. | 252/109 |
| 3,823,090 | 7/1974 | Kame et al. | 252/89 |
| 3,853,780 | 12/1974 | Mostow et al. | 252/132 |
| 3,858,854 | 1/1975 | Win et al. | 252/89 |
| 3,950,277 | 4/1976 | Stewart et al. | 252/541 |
| 3,953,353 | 4/1976 | Barrett, Jr. et al. | 252/174 |
| 4,004,980 | 1/1977 | Emery et al. | 195/68 |
| 4,009,076 | 2/1977 | Green et al. | 195/63 |
| 4,013,622 | 3/1977 | DeJuneas et al. | 260/45.95 S |
| 4,016,040 | 4/1977 | Win et al. | 195/68 |
| 4,016,041 | 4/1977 | van Kampen | 195/68 |
| 4,017,598 | 4/1977 | Ohno et al. | 424/35 |
| 4,025,391 | 5/1977 | Kawashima et al. | 195/68 |
| 4,029,264 | 6/1977 | Reese | 242/1 |
| 4,029,459 | 6/1977 | Schmiedeke | 425/202 |

FOREIGN PATENT DOCUMENTS

| | | |
|---|---|---|
| 1227855 | 11/1966 | Fed. Rep. of Germany . |
| 52-126930 | 1/1977 | Japan . |
| 67/7178 | 2/1969 | South Africa . |
| 1361387 | 7/1974 | United Kingdom . |
| 1362365 | 8/1974 | United Kingdom . |
| 1337725 | 12/1974 | United Kingdom . |
| 1469072 | 3/1977 | United Kingdom . |

*Primary Examiner*—Lionel M. Shapiro
*Attorney, Agent, or Firm*—Edmund F. Gebhardt; Thomas H. O'Flaherty; Richard C. Witte

[57] ABSTRACT

An article, primarily for use in detergent compositions, comprising an enzyme dispersed in a water-soluble resin film. Plasticizers, suds modifiers, solids, and surface-active agents may also be dispersed in said article.

27 Claims, No Drawings

WATER-SOLUBLE ENZYME-CONTAINING ARTICLE

BACKGROUND OF THE INVENTION

This invention relates to compositions which permit the convenient, safe and efficient incorporation of enzymes into detergent products. More particularly, this invention relates to dispersing an enzyme into a water-soluble resin and forming the resin, e.g. by casting or extruding into a sheet. The sheet is then dried, if necessary, and, if required, cut into "ribbons" for incorporation into the detergent product. The ribbons of enzyme-dispersed resin may be admixed with a detergent composition in granular, viscous liquid, paste or gel form. The resulting mixture may be used directely in the washing process, particularly in an automatic dishwasher, or it may be incorporated within a water-soluble packet, for easy and convenient dispensing.

Compositions wherein enzymes are encapsulated in small size granules using water-soluble resins are fairly well-known in the art. However, these prior art compositions exhibit one or more deficiencies when processed and incorporated into detergent products. Dusting is a problem when conventional enzyme granules are produced and incorporated into detergent compositions. The conventional enzyme granules may break open, thereby causing a safety hazard, particularly to those manufacturing the granules. The dispersion of small granules throughout the detergent composition makes it exceedingly difficult to recycle the enzyme component from scrapped product in order to minimize manufacturing waste of this relatively expensive component.

Problems are also encountered when enzymes generally are sought to be incorporated into detergent compositions. The enzymes tend to degrade and become inactive in the highly alkaline detergent composition environment. Further, the enzymes will generally be released into the washing solution before the solution reaches the pH at which the enzyme exhibits its optimum activity, while they are simultaneously subjected to interference and attack from incompatible components, such as phosphates, in the washing solution. Thus, it would be particularly beneficial for the enzyme to be protected from these incompatible components, until the wash solution reaches the pH at which the enzyme exhibits its optimum activity.

It is an object of this invention to provide an article which yields controlled enzyme release in wash water solution resulting thereby in improved enzyme performance.

It is also an object of this invention to provide an enzyme-containing product yielding improved enzyme stability in detergent compositions.

It is another object of this invention to provide an enzyme-containing article which minimizes the dusting of the enzyme components.

It is also another object of this invention to provide for improved user and manufacturer safety and hygiene in formulation of leak-proof enzyme compositions.

It is still another object of this invention to provide for the convenient and efficient recycling of unused enzyme-containing articles.

It is a further object of this invention to simplify packaging equipment and procedures for incorporating enzymes into detergent compositions.

It is also a further object of this invention to provide for improved product aesthetics of enzyme compositions.

It is a still further object of this invention to provide an enzyme-containing article which permits the economical handling and packaging of enzyme compositions into small detergent-containing packets.

It is even a further object of this invention to provide for a relatively noncrushable enzyme-containing article.

SUMMARY OF THE INVENTION

The present invention encompasses a nondusting article comprising an enzyme dispersed in a water-soluble, resin film, wherein one dimension of the article is at least about 3 millimeters in size and the thickness of the article is not more than about 1000 mils. A preferred method of making these articles is by dispersing enzyme into a water-soluble resin, casting or extruding the resin into a sheet and then drying or cooling it, if necessary.

Plasticizers, solid materials, suds modifiers, and surface active agents may be incorporated into the enzyme-dispersed resin sheet or film for product and film needs. The enzyme-dispersed resin film may be foamed during production to increase its solubility.

In a preferred embodiment, the enzyme articles of the present invention are included in detergent compositions, which may be in solid, viscous liquid, paste or gel form. It is particularly preferred that the detergent compositions, together with the articles of the present invention, be included in water-soluble packets for use in automatic dishwashers, such as those described in concurrently filed U.S. patent application Ser. No. 789,325, filed Apr. 20, 1977, U.S. Pat. No. 4,115,292, issued Sept. 19, 1978, incorporated by reference. Through the use of these preferred embodiments the time of release of the enzyme into the wash water solution may be controlled.

DETAILED DESCRIPTION OF THE INVENTION

The articles of the present invention contain two essential components, an enzyme and a water-soluble, film-forming resin, each of which will be described in detail hereinafter.

Resins suitable for use in the articles of the present invention are water-soluble, are film-formers, and, preferably, are organic.

Suitable water-soluble, film-forming resins are described in Davidson and Sittig, *Water-Soluble Resins,* Van Nostrand Reinhold Company, New York (1968), herein incorporated by reference. The water-soluble resin should have proper characteristics, such as strength and pliability, to permit machine handling. Preferred water-soluble resins include polyvinyl alcohol, cellulose ethers, polyethylene oxide, starch, polyvinylpyrrolidone, polyacrylamide, polyvinyl methyl ether-maleic anhydride, polymaleic anhydride, styrene maleic anhydride, hydroxyethylcellulose, methylcellulose, polyethylene glycols, carboxymethylcellulose, polyacrylic acid salts, alginates, acrylamide copolymers, guar gum, casein, ethylene-maleic anhydride resin series, polyethyleneimine, ethyl hydroxyethylcellulose, ethyl methylcellulose, hydroxyethyl methylcellulose. Lower molecular weight water-soluble, polyvinyl alcohol film-forming resins are preferred.

Generally, preferred water-soluble, polyvinyl alcohol film-forming resins should have relatively low average molecular weight and low levels of hydrolysis in water. Polyvinyl alcohols preferred for use herein have an average molecular weight between 1,000 and 300,000, preferably between 2,000 and 100,000 most preferably between 2,000 and 75,000. Hydrolysis, or alcoholysis, is defined as the percent completion of the reaction where acetate groups on the resin are substituted with hydroxyl, —OH, groups. A hydrolysis range of from 60–99% of polyvinyl alcohol film-forming resin is preferred, while a more preferred range of hydrolysis is from about 70–90% for water-soluble, polyvinyl alcohol film-forming resins. The most preferred range of hydrolysis is 80–88%. As used in this application, the term "polyvinyl alcohol" includes polyvinyl acetate compounds with levels of hydrolysis disclosed herein. The enzyme-dispersed, water-soluble resin film should be formulated so as to substantially completely dissolve in 130° F. water with agitation within about five minutes, preferably within about three minutes in 100° F. water with agitation, and most preferably within about one minute in 100° F. water with agitation.

Polyvinyl alcohol is a particularly preferred resin for use in the articles of the present invention. Since polyvinyl alcohol is usually dissolved in water prior to its use, its film-forming abilities are extremely important in most applications. Polyvinyl alcohol films do not require a curing cycle, because film formation occurs readily by simply evaporating water from the solution.

When compared to plastics, the tensile strength of polyvinyl alcohol is relatively high, and when compared with other water-soluble materials, the tensile strength of polyvinyl alcohol is extremely high. Reasonable tensile strength is required in films used in articles of the present invention in order to permit proper handling and machining of the articles. The tensile strength of polyvinyl alcohol will vary with a number of factors, including the percent hydrolysis, degree of polymerization, plasticizer content, and humidity.

When other factors are remaining constant, the tensile strength of polyvinyl alcohol will increase with the degree of polymerization. Films cast from unplasticized polyvinyl alcohols of high, medium, and low viscosity, and conditioned at 35% relative humidity, showed average tensile strengths of 18,000, 17,000, and 9,000 psi, respectively.

Tensile strength values of polyvinyl alcohol decrease as the degree of alcoholysis or hydrolysis decreases. At 50% relative humidity, films cast from completely alcoholized, high-viscosity polyvinyl alcohol have tensile strengths approximately 20% higher than films cast from high-viscosity polyvinyl alcohol which is only 88% alcoholized.

Addition of plasticizers, such as glycerin, to polyvinyl alcohol results in a decrease in film tensile strength, although such addition markedly improves the elongation characteristics of the resulting film. Elongation varies from less than 10% to more than 600% as a direct result of plasticizer addition to the polyvinyl alcohol film.

Polyvinylpyrrolidone, another preferred resin for use in the articles of the present invention, may be cast from a variety of solvents to produce films which are clear, glossy, and reasonably hard at low humidities. These polyvinylpyrrolidone films exhibit excellent adhesion to a wide variety of surfaces, including glass, metals, and plastics. Unmodified films of polyvinylpyrrolidone are hygroscopic in character. Dry polyvinylpyrrolidone film has a density of 1.25 and a refractive index of 1.53. Tackiness at higher humidities may be minimized by incorporating compatible, water-insensitive modifiers into the polyvinylpyrrolidone film, such as 10% of an aryl-sulfonamide-formaldehyde resin.

Preferred water-soluble films may also be prepared from polyethylene oxide resins by standard calendering, molding, casting, extrusion, and other conventional techniques. The polyethylene oxide films may be clear or opaque, and are inherently flexible, tough, and resistant to most oils and greases. These polyethylene oxide resin films provide better solubility than other water-soluble plastics without sacrificing strength or toughness. The excellent ability to lay flat, stiffness, and sealability of water-soluble polyethylene oxide films make for good machine handling characteristics.

The weight percent of water-soluble, film-forming resin in the final articles of the present invention is from about 10% to about 90%, preferably about 15% to about 75%, and most preferably about 20% to about 50%.

The second essential component of this invention is the enzyme which is dispersed in the water-soluble, film-forming resin. This component comprises an effective amount of a single enzyme, such as a proteolytic or amylolytic enzyme, or an enzyme mixture, suitable for use in a cleaning, particularly an automatic dishwashing, composition. Such enzymes are disclosed in U.S. Pat. No., 3,627,688, McCarty et al, Dec. 14, 1971, incorporated herein by reference. It is preferred that the enzyme component constitute from about 5 to about 75% by weight, particularly from about 10 to about 60% by weight, more particularly from about 15% to about 50% by weight of the articles of the present invention.

Where the articles are incorporated into a detergent composition for use in automatic dishwashers, a preferred enzyme component is an effective amount of an enzyme mixture which comprises a proteolytic enzyme having a proteolytic activity of 80% to 100% of maximum activity when measured at pH 12 using the Anson Hemoglobin method carried out in the presence of urea, and an amylolytic enzyme, as described in copending U.S. patent application Ser. No. 699,416, Maguire and Pancheri filed June 24, 1976, incorporated herein by reference. The enzyme mixture is used in an amount such that the final detergent composition has an amylolytic activity of at least 150 Kilo Novo units per kilogram and a proteolytic activity of at least about 6.0 Anson units per kilogram. This corresponds roughly to detergent compositions comprising from about 0.001% to about 5% of the enzyme mixture, utilizing generally available commercial enzyme preparations. More preferably, this corresponds to detergent compositions comprising from about 0.1% to about 1.5% of the enzyme mixture. The ratio of amylolytic to proteolytic enzyme in the enzyme mixture is from about 4:1 to about 1:4 by weight. Preferably the ratio of amylolytic to proteolytic enzyme in the enzyme mixture is from about 3:1 to about 1:2, and most preferably the enzymes are present in the mixture in a ratio of about 1:1.

Enzymes, or biological catalysts, are important and essential components of biological systems, their function being to catalyze and facilitate organic (and inorganic) reactions. For example, enzymes are essential to metabolic reactions occurring in animal and plant life.

All enzymes are proteins which, in general, are made of many amino acids of the L configuration linked by an amide bond between the carboxyl group of one amino acid and the alpha-amino group of another (peptide bond). It is also known that some proteolytic enzymes have crucial dependencies on nonprotein prosthetic groups or cofactors. A polypeptide is normally considered to be a protein when it contains minimally from about 40 to 75 peptide bonds. A cofactor can be termed as a substance required for manifestation of enzymatic activity and which emerges unchanged from the reaction. These cofactors apparently are not involved, however, in the catalytic events of enzyme function. Rather, their role seems to be one of maintaining the enzyme in an active configuration. Enzymes are considered to exhibit their catalytic activity by virtue of three general characteristics: the formation of a noncovalent complex with the substrate; substrate specificity; and catalytic activity. Many compounds may bind to an enzyme, but only certain types will lead to a subsequent reaction; the latter are called substrates and they satisfy the particular enzyme specificity requirement. Materials that bind but do not thereupon chemically react can affect the enzymatic reaction either in a positive or negative way. For example, unreacted species called inhibitors, can alter the enzymatic activity.

In detergent technology, enzymes aid and augment the removal of soils from objects to be cleaned. The enzymatic action may result from a series of individual chemical reactions inclusive of hydrolysis, oxidation, and substitution. As pointed out above, specific enzymes have a specific function either in terms of a particular chemical reaction or a particular kind of soil. Thus, the art has indicated that various types of enzymes may be combined in order to obtain cleaning power over a broad spectrum of soils. However, a mixture of these specially selected proteolytic enzymes together with an amylolytic enzyme will impart a unique, improved cleaning benefit in an automatic dishwashing detergent composition.

The preferred proteolytic enzymes are those which exhibit a proteolytic activity of 80% to 100% of maximum activity when measured at pH 12 using the Anson Hemoglobin method carried out in the presence of urea. The Anson Hemoglobin method is described in the *Journal of General Physiology,* Vol. 22, pp. 79–89 (1939). These enzymes may be obtained by the aerobic cultivation of protease-forming species of the genus bacillus on a nutrient medium having a pH within the range of 9 to 11 and maintaining, during the major period of said cultivation, a pH in the nutrient medium between 7.5 and 10.5. A method for the preparation of such enzymes is given in British Patent Specification 1,234,784, incorporated herein by reference.

Proteolytic enzymes preferred for use in the present invention are described in the disclosure of British Patent Specification 1,361,386, incorporated herein by reference. Particularly preferred proteolytic enzymes are the strain numbers C372, C303, C367, and C370; all of these latter references correspond to bacterium strains which have been deposited at the National Collection of Industrial Bacteria, Torry Research Station, Aberdeen, Scotland (NCIB). NCIB numbers for enzymes useful in the present invention are given in the specification of Belgian Patent 721,730, incorporated herein by reference. Listed hereafter are, as examples, the NCIB numbers for the bacterium strains producing preferred enzymes species suitable for being used with the compositions of this invention; C372 corresponds to NCIB 10 317; C303 corresponds to NCIB 10 147; C367 corresponds to NCIB 10 313; and C370 corresponds to NCIB 10 315. The full series of NCIB numbers can be found on pages 4, 5, and 6 of the specification of the Belgian patent referred to hereinbefore.

Another preferred enzyme for use in the compositions of the present invention is that cultivated from the microorganism of bacillus firmus strain NRS 783, as described in U.S. Pat. No. 3,827,938, Aunstrup et al, issued Aug. 6, 1974, incorporated herein by reference. Bacillus firmus strain NRS 783 may be obtained from the U.S. Department of Agriculture, Agricultural Research Service, Peoria, Illinois, as strain NRRL B 1107. Particularly preferred proteolytic enzymes are those cultivated from strains NCIB 10147 and NRRL B 10017 and mixtures thereof.

Preferred, commercially available proteolytic enzymes for use in the compositions of the present invention, are available under the tradenames SP-72 (ESPERASE) and SP-88, produced and marketed by Novo Industri A/S, Copenhagen, Denmark.

The particularly selected proteolytic enzyme is combined with an amylolytic enzyme, derived from bacteria or fungi. Preferred amylolytic enzymes are those which exhibit an amylolytic activity of greater than 50% of maximum activity when measured at pH 8 by the SKB method at 37° C. The SKB method is described in *Cereal Chemistry,* Vol. 16, p. 712 (1939), and British Patent Specification No. 1,296,839, incorporated herein by reference.

Preferred amylolytic enzymes for use in the present invention include Monsanto DA 10, commercially available from Monsanto; RAPIDASE, available from Societé Rapidasé, France; MILEZYME, available from Miles Laboratories, Elkhart, Indiana; and BAN, available from Novo Industri A/S. Particularly preferred amylolytic enzymes are those prepared and described in British Patent Specification No. 1,296,839, incorporated herein by reference, cultivated from the strains of bacillus lichenformis NCIB 8061; NCIB 8059; ATCC (America Type Culture Collection) 6334; ATCC 6598; ATCC 11945; ATCC 8480; and ATCC 9945A. A particularly preferred, commercially available amylolytic enzyme, is produced and distributed under the tradename SP-95 (Termamyl), by Novo Industri A/S, Copenhagen, Denmark.

The proteolytic and amylolytic enzymes, described above, are combined in a ratio of from about 4:1 to about 1:4 by weight, and the preferred enzyme mixture is present in the detergent composition in an amount such that the detergent composition has an amylolytic activity of at least 150 Kilo Novo units per kilogram, preferably at least 300 Kilo Novo units/kg., and a proteolytic activity of at least 6.0 Anson units per kilogram. The amylolytic activity is determined in Kilo Novo units by a procedure which is a modification of the SKB method without the addition of beta-amylase. The procedure for determining the activity in Novo units is described in U.S. Pat. No. 3,931,034, Inamorato et al, issued Jan. 6, 1976, incorporated herein by reference. The proteolytic activity of the mixture is measured in Anson units, which is that amount of proteolytic enzyme that degrades hemoglobin under the standard conditions as described by M. L. Anson in the *Journal of General Physiology,* Vol 22, supra.

The enzyme-containing articles of the present invention may also contain other additives, such as plasticizers, solids, and suds modifiers.

Preferred plasticizers which may be added to the water-soluble, film-forming resins include $C_2$-$C_6$ glycols and polyglycols, glycerol, sorbitol, triethanolamine and mixtures of these components. The plasticizers make the films more flexible and easier to manufacture and handle. Plasticizers are included in a weight percent range of about 0% to about 80%, preferably from about 10% to about 50%, most preferably from about 10% to about 30%. Unsupported water-soluble films have been prepared from solutions which were cast on metal belts or by extrusion of high solids dispersions formulated with plasticizers such as glycerol or sorbitol. Starch films are almost always impermeable to oxygen and nitrogen, even though the starch films transmit water vapor. Unless these starch films are highly plasticized, they will become too brittle at low humidities. Higher levels of less effective plasticizers such as nonionic surface-active agents may be used.

The flexibility of hydroxypropyl methyl cellulose films depends upon plasticization, either internally or externally, or upon viscosity. A variety of plasticizers are suitable for hydroxypropyl methyl cellulose films, including sorbitol, glycerol, ethylene glycol, propylene glycol, triethanolamine, diethylene glycol, propylene glycol, and hydroxypropyl sucrose.

Hydroxyethylcellulose films can be plasticized, for applications which will require greater flexibility and elongation. By adding 5 to 30 weight percent of plasticizer, film elongation and flexibility of hydroxyethylcellulose films can be increased. Plasticizers that have been proven effective in hydroxyethylcellulose films include glycerol, ethanolamines, glycols, sorbitol, sulfonated oil, and polyglycols ($C_2$–$C_6$ glycols)$_{2\text{-}100}$. These plasticizers have a profound effect on the impact resistance of hydroxyethylcellulose films. In addition to compatibility with plasticizers, hydroxyethylcellulose films can be modified with various natural gums and synthetic resins to alter the properties of the film. Gums and resins compatible with hydroxyethylcellulose films include dextrin, borated dextrin, gum arabic, gum Karaya, gum Tragacanth, sodium alginate, sodium carboxymethylcellulose, while semi-compatible resins include casein, gelatin, methylcellulose, starch, and polyvinyl alcohol.

Plasticizers that have been found to be most effective in imparting softness and flexibility characteristics to polyvinyl alcohol resin include some of the high-boiling point, water-soluble organic compounds containing hydroxy, amide, or amino groups. The ester-type, water-immiscible plasticizers which are commonly used with plastics are not normally compatible with polyvinyl alcohol resin.

At the present time, the most widely-used plasticizer for polyvinyl alcohol resin is glycerin. Glycerin is compatible in substantial proportions with both the partially and completely hydrolyzed types of polyvinyl alcohol resin, and has good stability, resistance to extraction by organic solvents, and a high softening effect.

Ethylene glycol and some of the lower polyethylene glycols can also act as plasticizers for polyvinyl alcohol resin. Triethylene glycol is particularly suited for use with the partially-hydrolyzed types of polyvinyl alcohol resins in the formation of extremely soft, resilient compositions.

Tetraethylene, and nonaethylene glycols are also particularly useful as plasticizers. These compositions have lower vapor pressures than triethylene glycol, but their compatibility with polyvinyl alcohol decreases as the molecular weights of the glycols increase. In general, the polyethylene glycols are less compatible than glycerin with completely hydrolyzed grades of polyvinyl alcohol resin.

Ethanolacetamide and ethanolformamide have also been found to be effective plasticizers for polyvinyl alcohol, particularly, for the partially-hydrolyzed grades of resin. Formamide is compatible in substantial proportions and has a high softening effect. However, the plasticizing action of formamide is only temporary, because of formamide's high vapor pressure. Ethanolamine salts, such as the acetate and the hydrochloride of triethanolamine, may also be used for plasticizing both the completely and partially hydrolyzed types of polyvinyl alcohol resin. Except in very dry atmospheres, sodium and ammonium thiocyanates may also be used as plasticizers for polyvinyl alcohol resin. Since plasticizers are hygroscopic in nature, and since water is very effective in imparting softness and elasticity to polyvinyl alcohol, plasticity of these various agents varies to some extent with humidity. The flexibility is reduced and hardness increased at low temperatures and humidities of these particular plasticizing agents.

Polyacrylamide resin in its soluble or insoluble forms produces hard-brittle films. Therefore, in some cases it is desirable to incorporate about 5% of a plasticizer in such formulations containing polyacrylamide in order to obtain improved flexibility. Such plasticizers which work well in polyacrylamide resins include polypropylene glycol, tridecyl alcohol-ethylene oxide adduct, (Renex 30, commercially available from Atlas Powder Co.), and sorbitan monooleate-ethylene oxide adduct.

Urea has a slight plasticizing effect on polyvinyl alcohol resin, but is generally included in such resins as an extender. Water-soluble, urea-formaldehyde and phenolformaldehyde resins can be used both to lower the price and increase the water resistance of polyvinyl alcohol resin compositions. It is customary to use 10 to 30% of these resins, based on the weight of the polyvinyl alcohol resin within the composition. Low-priced pigments such as clay and whiting also make useful extenders too. It is often advisable to use a surface-active agent to facilitate dispersion of extender pigments and also to decrease the viscosity of the urea.

Urea may be specifically added to increase the solubility of the water-soluble resin carrier in weight percent ranges of about 5 to about 90%, preferably about 10% to about 60% by weight, more preferably about 10% to about 50% by weight, and most preferably about 20% to about 40%, by weight. The solubility rate of the water-soluble resin carrier tends to increase as the weight cencentration of the urea in the water-soluble resin carrier increases, as is described in concurrently filed U.S. patent application Ser. No. 789,324 filed Apr. 20, 1977, now abandoned, Guerry, incorporated herein by reference.

Solids may be incorporated into the water-soluble, enzyme-dispersed film as extenders. Useful materials in this regard include particulate starch, urea, dextrin and sodium sulfate. Preferred weight percent ranges of solids are from 0% to about 50%, preferably from about 10% to about 40%, and most preferably from about 20% to about 30% by weight.

The articles of the present invention may also contain suds modifiers in order to control the volume of suds produced when the articles are used in detergent compositions, particularly automatic dishwashing detergent compositions. It is preferred that these suds modifiers be present in the articles in an amount of from about 0% to about 10%, most preferably from about 3% to about 7% by weight.

The suds modifiers or suds-regulating agents may be included for the purpose of controlling the sudsing of the film composition during production. Excessive sudsing can have the effect of decreasing the efficiency of the dishwashing machine and, hence, should be avoided. The final selection of the suds-suppressing agent depends, at least in part, upon the qualitative and quantitative characteristics of the particular components, especially the surface-active agent, which is utilized in the detergent composition. Suds-regulating agents are particularly useful in automatic dishwashing detergent compositions since some types of food residues, especially proteinaceous food residues, exhibit suds-boosting properties.

Suds-regulating components are normally used in an amount of from about 0.001% to about 5%, preferably from about 0.05% to about 3%, and especially from about 0.1% to about 1%, of the final detergent composition. Suds-suppressing agents known in the art to be suitable for use in the detergent context are useful in the compositions herein.

Preferred suds-suppressing additives are described in U.S. Pat. No. 3,933,672, Bartolotta et al, issued Jan. 20, 1976, incorporated herein by reference, relating to silicone suds-controlling agents. The silicone material can be represented by alkylated polysiloxane materials such as silica aerogels and xerogels, and hydrophobic silicas of various types. The silicone material may be described as a siloxane having the formula:

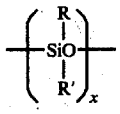

wherein x is from about 20 to about 2,000 and R and R′ are each alkyl or aryl groups, especially methyl, ethyl, propyl, butyl, and phenyl. The polydimethyl siloxanes (R and R′ are methyl) having a molecular weight within the range of from about 200 to 200,000, and higher, are all useful as suds controlling agents. Additional suitable silicone materials, wherein the side chain groups R and R′ are alkyl, aryl, or mixed alkyl and aryl hydrocarbyl groups, exhibit useful suds controlling properties. Examples of such ingredients include diethyl-, dipropyl-, dibutyl-, methyl and ethyl-, and phenylmethyl polysiloxanes and the like. Additional useful silicone suds controlling agents can be represented by a mixture of an alkylated siloxane, as referred to above, and solid silica. Such mixtures are prepared by affixing the silicone to the surface of the solid silica. A preferred silicone suds controlling agent is represented by a hydrophobic silanated (most preferably trimethylsilanated) silica having a particle size in the range of from about 10 millimicrons to 20 millimicrons in a specific surface area above about 50 square meters per gram, intimately admixed with dimethyl silicone fluid having a molecular weight in the range of from about 500 to about 200,000 at a weight ratio of silicone to silanated silica of from about 19:1 to about 1:2. The silicone suds suppressing agent is advantageously releaseably incorporated in a water-soluble or water-dispersible, substantially nonsurface-active detergent-impermeable carrier.

Particularly useful suds-suppressors are the self-emulsified silicone suds-suppressors described in U.S. patent application Ser. No. 731,257, Gault et al, filed Oct. 12, 1976, incorporated herein by reference. An example of such a compound is DB-544, which is a mixture of silica, an alkoxylated siloxane, and a siloxane/glycol copolymer, and is commercially available from Dow Corning.

Microcrystalline waxes having a melting point in the range of from 35° C. to 115° C. and a saponification value less than 100, represent an additional example of a preferred suds regulating component for use in the subject compositions. The microcrystalline waxes are substantially water-insoluble, but are water-dispersible in the presence of organic surfactants. Preferred microcrystalline waxes have a melting point of from about 65° C. to 100° C., a molecular weight in the range of 400 to 1000, and a penetration value of at least 6, measured at 77° F. by ASTM-D1321. Suitable examples of the above waxes include: microcrystalline and oxidized microcrystalline petrolatum waxes; Fischer-Tropsch and oxidized Fischer-Tropsch waxes; ozokerite; ceresin; montan wax; beeswax; candelilla; and carnauba wax.

Alkyl phosphate esters represent an additional preferred suds suppressant for use herein. These preferred phosphate esters are predominantly monostearyl acid phosphate which, in addition thereto, can contain di- and tristearyl phosphates and monooleyl phosphates, which can contain di and trioleyl phosphates.

The alkyl phosphate esters frequently contain some trialkyl phosphate. Accordingly, a preferred phosphate ester can contain, in addition to the monoalkyl ester, e.g., monostearyl phosphate, up to about 50 mole percent of dialkyl phosphate and up to about 5 mole percent of trialkyl phosphate.

The articles of the present invention may also contain a surface-active agent, preferably in weight percentages of about 0% to about 80%, more preferably from about 1% to about 40%, and most preferably from about 10% to about 30% of the article, of the types disclosed hereinafter.

In a particularly preferred embodiment, the articles of the present invention are included in detergent compositions, particularly detergent compositions for use in automatic dishwashers. These compositions may be in solid particulate, viscous liquid, gel or paste form.

The detergent compositions which may be used in conjunction with the articles of the present invention contain water-soluble anionic, nonionic, ampholytic or zwitterionic surface-active agents, or mixtures of these surfactants. Surfactants known in the detergency arts may be used in the compositions herein. Examples of such surfactants are listed in U.S. Pat. No. 3,717,630, Booth, issued Feb. 20, 1973, and U.S. Pat. No. 3,332,880, Kessler et al, issued July 25, 1967, both of which are incorporated herein by reference. A preferred type of anionic surfactant is disclosed in U.S. Pat. No. 3,941,710, Gilbert et al, issued Mar. 2, 1976, incorporated herein by reference.

Where the detergent compositions are for use in automatic dishwashers, it is preferred that they contain a nonionic surface-active agent, particularly an alkoxylated nonionic surface-active agent, wherein the alkoxy moiety is ethylene oxide, propylene oxide, or mixtures thereof. The surface-active component should comprise at least about 0.5% by weight of the detergent composition. However, by choosing an appropriate nonionic surfactant system, along with small quantities of materials such as solubilizers, thickeners, and the like, stable paste-form compositions containing up to about 55% of the nonionic surfactant system may be prepared. Preferred detergent compositions contain from about 1 to about 40% of the nonionic surfactant, most preferably from about 3 to about 30%.

Most commonly, nonionic surfactants are compounds produced by the condensation of an alkylene oxide, especially ethylene oxide (hydrophilic in nature) with an organic hydrophobic compound, which is usually aliphatic or alkyl aromatic in nature. The length of the hydrophilic polyoxyalkylene moiety which is condensed with any particular hydrophobic compound can be readily adjusted to yield a water-soluble compound having the desired degree of balance between hydrophilic and hydrophobic properties. A typical listing of classes and species of such nonionic surfactants useful herein appears in U.S. Pat. No. 3,664,961, incorporated herein by reference.

Preferred nonionic surface-active agents include alkoxylated nonionic surfactants wherein the alkoxy moiety is selected from the group consisting of ethylene oxide, propylene oxide, and mixtures thereof. Ethylene oxide represents the preferred condensation partner. The alkylene oxide moiety is condensed with a nonionic-based material according to techniques known in the art. All alkoxylated nonionic detergents which are normally known to be suitable for use in detergent technology can be used herein. Examples of such components include:

(1) The condensation product of one mole of a saturated or unsaturated, straight or branched chain carboxylic acid having from about 10 to about 18 carbon atoms with from about 3 to about 50 moles of ethylene oxide. The acid moiety can consist of mixtures of acids in the above-delineated carbon atoms range or it can consist of an acid having a specific number of carbon atoms within this range. The condensation product of one mole of coconut fatty acid having the approximate carbon chain length distribution of 2% $C_{10}$, 66% $C_{12}$, 23% $C_{14}$, and 9% $C_{16}$ with 35 moles of ethylene oxide is a specific example of a nonionic containing a mixture of different chain length fatty acid moieties. Other specific examples of nonionics of this type are: the condensation product of one mole of palmitic acid with 40 moles of ethylene oxide; the condensation product of one mole of myristic acid with 35 moles of ethylene oxide; the condensation product of one mole of oleic acid with 5 moles of ethylene oxide; and the condensation product of one mole of stearic acid with 30 moles of ethylene oxide.

(2) The condensation products of one mole of a saturated or unsaturated, straight or branched chain alcohol having from about 10 to about 24 carbon atoms with from about 3 to about 50 moles of ethylene oxide. The alcohol moiety can consist of mixtures of alcohols in the above-delineated carbon atom range or it can consist of an alcohol having a specific number of carbon atoms within this range. The condensation product of one mole of coconut alcohol having the approximate chain length distribution of 2% $C_{10}$, 66% $C_{12}$, 23% $C_{14}$, and 9% $C_{16}$ with 45 moles of ethylene oxide is a specific example of a nonionic containing a mixture of different chain length alcohol moieties. Other specific examples of nonionics of this type are the condensation products of one mole of tallow alcohol with 9 and 20 moles of ethylene oxide respectively; the condensation products of one mole of lauryl alcohol with 35 moles of ethylene oxide; the condensation products of one mole of myristyl alcohol with 30 moles of ethylene oxide; and the condensation products of one mole of oleyl alcohol with 40 moles of ethylene oxide.

(3) Polyethylene glycols having a molecular weight of from about 400 to about 30,000. For example, Dow Chemical Company manufactures these nonionics in molecular weights of 20,000, 9500, 7500, 4500, 3400, and 1450, all of which are waxlike solids which melt between 110° F. and 200° F.

(4) The condensation products of one mole of alkyl phenol wherein the alkyl chain contains from about 8 to about 18 carbon atoms with from about 3 to about 50 moles of ethylene oxide. Specific examples of these nonionics are the condensation products of one mole of decyl phenol with 40 moles of ethylene oxide; the condensation products of one mole of dodecyl phenol with 35 moles of ethylene oxide; the condensation products of one mole of tetradecyl phenol with 35 moles of ethylene oxide; and the condensation products of one mole of hexadecyl phenol with 30 moles of ethylene oxide.

(5) The ethoxylated surfactants disclosed in U.S. patent application Ser. No. 557,217, filed March 10, 1975, inventor Jerome H. Collins, incorporated herein by reference, consisting essentially of a mixture of compounds having at least two levels of ethylene oxide addition and having the formula: $R_1—R_2—O(CH_2CH_2O)_nH$, wherein $R_1$ is a linear alkyl residue and $R_2$ has the formula $—CHR_3CH_2—$ wherein $R_3$ is selected from the group consisting of hydrogen and mixtures thereof with not more than 40% by weight of lower alkyl, wherein $R_1$ and $R_2$ together form an alkyl residue having a mean chain length in the range of 8–15 carbon atoms, at least 65% by weight of said residue having a chain length within ±1 carbon atom of the mean, wherein $3.5<n<6.5$, provided that the total amount of components in which $n=0$ is not greater than 5% by weight and the total amount of components in which $n=2$–7 inclusive is not less than 63% by weight, and the hydrophilic-lipophilic balance (HLB) of said ethoxylate material is in the range from 9.5–11.5, said surfactant composition being otherwise free of nonionic surfactants having an HLB outside of said range.

Low-foaming alkoxylated nonionic surfactants are preferred for use in the detergent compositions, although nonionics which do not exhibit low-foaming properties can be used without departing from the spirit of this invention, as long as they are used in conjunction with a suds-regulating agent so as to control the foaming characteristics of the detergent composition as a whole. Examples of nonionic low-foaming surface-active components include: the condensation products of benzyl chloride and an ethoxylated alkyl phenol wherein the alkyl group has from about 6 to about 12 carbon atoms and wherein from about 12 to about 20 ethylene oxide molecules have been condensed per mole of alkyl phenol; polyetheresters of the formula $$(ClC_6H_4)_2CHCO_2(CH_2.CH_2.O)_xR$$

wherein x is an integer from 4 to 20 and R is a lower alkyl group consisting not more than 4 carbon atoms, for example a component having the formula $$(ClC_6H_4)_2CHCO_2(CH_2CH_2O)_{15}.CH_3;$$

the polyalkoxylation products of alkyl phenol, for example, the polyglycol alkyl phenol ethers containing an alkyl group having at least 6 and, normally, from about 8 to about 20 cabon atoms and having a molar ratio of ethylene oxide to alkyl phenol of about 7.5; 9.0; 11.5; 20.5; and 30. The alkyl group can, for example, be represented by diisobutylene; di-amyl; polymerized propylene; iso-octyl; and nonyl.

Additional examples of effective low-foaming nonionics include: the polyalkylene glycol condensates disclosed in U.S. Pat. No. 3,048,548, hereby incorporated by reference, having alternating hydrophilic oxyethylene chains and hydrophobic oxypropylene chains wherein the weight of the terminal hydrophobic chains, the weight of the middle hydrophobic unit and the weight of the linking hydrophilic units each represent about $\frac{1}{3}$ of the condensate; the de-foaming nonionic surfactants disclosed in U.S. Pat. No 3,382,178, incorporated herein by reference, having the general formula $Z[(OR)_nOH]_z$ wherein Z is alkoxylatable material, R is a radical derived from an alkylene oxide which can be ethylene and propylene and n is an integer from, for example, 10 to 2000 or more and z is an integer determined by the number of reactive oxyalkylatable groups. Z can be represented by normal biodegradable alcohols such as, for example, those obtained by reduction of fatty acids derived from coconut oil, palm kernel oil, tallow and also those obtained from petroleum such as, for example, the mixtures of $C_{10}$ to $C_{18}$ straightchain primary alcohols; the nonionic surface-active agents of U.S. Pat. No. 3,549,539 being a mixture of nonylphenol-5-EO or the condensation product of a random $C_{11}$ to $C_{15}$ secondary alcohol and ethylene oxide having an HLB value between 11.5 and 13.5; and a polyethylene oxide/polypropylene oxide condensate that consists of between 5 and 25% polyethylene oxide and 95 and 75% polypropylene oxide and has a molecular weight between 1500 and 2700; the conjugated polyoxyalkylene compounds described in U.S. Pat. No. 2,677,700, incorporated herein by reference, corresponding to the formula:

$$Y(C_3H_6O)_n(C_2H_4O)_mH$$

wherein Y is the residue of organic compounds having from about 1 to 6 carbon atoms and at least one reactive hydrogen atom, n has an average value of at least about 6.4, as determined by hydroxyl number and m has a value such that the oxyethylene portion constitutes about 10 to 90 weight percent of the molecule; the conjugated polyoxyalkylene compounds described in U.S. Pat. No. 2,674,619, incorporated herein by reference, having the formula:

$$Y[(C_3H_6O)_n(C_2H_4O)_mH]_x$$

wherein Y is the residue of organic compounds having from about 2 to 6 carbon atoms and containing x reactive hydrogen atoms in which x has a value of at least about 2, n has a value such that the molecular weight of the polyoxypropylene hydrophobic base is at least about 900 and m has a value such that the oxyethylene content of the molecule is from about 10 to 90 weight percent. Compounds falling within the scope of the definition for Y include, for example, propylene glycol, glycerine, pentaerythritol, trimethylolpropane, ethylenediamine and the like. The oxypropylene chains optionally, but advantageously, contain small amounts of ethylene oxide and the oxyethylene chains also optionally, but advantageously, contain small amounts of propylene oxide.

Additional conjugated polyoxyalkylene surface-active agents which are advantageously used in the compositions of this invention correspond to the formula:

$$P[C_3H_6O)_n(C_2H_4O)_mH]_x$$

wherein P is the residue of organic compounds having from about 8 to 18 carbon atoms and containing x reactive hydrogen atoms in which x has a value of 1 or 2, n has a value such that the molecular weight of the polyoxypropylene portion is at least about 58 and m has a value such that the oxyethylene content of the molecule is from about 10 to 90 weight percent and the formula:

$$P[(C_2H_4O)_n(C_3H_6O)_mH]_x$$

wherein P is the residue of an organic compound having from about 8 to 18 carbon atoms and containing x reactive hydrogen atoms in which x has a value of 1 or 2, n has a value such that the molecular weight of the polyoxyethylene portion is at least about 44 and m has a value such that the oxypropylene content of the molecule is from about 10 to 90 weight percent. In either case the oxypropylene chains may contain optionally, but advantageously, small amounts of ethylene oxide and the oxyethylene chains may contain also optionally, but advantageously, small amounts of propylene oxide.

Preferred nonionic surfactants for use in the present invention include the mono- and polyalkoxy-substituted surfactants having the terminal hydroxyl of the alkoxy group acylated by certain monobasic acids ("capped" surfactants), described in U.S. patent application Ser. No. 621,456, Williams, filed Oct. 10, 1975, incorporated herein by reference.

Highly preferred alkoxylated nonionics for use herein include the condensation product of one mole of tallow alcohol with from about 6 to about 20 moles, especially 9 moles, of ethylene oxide; the alkoxylate commercially available under the tradename PLURADOT HA-433 ® Wyandotte Chemical Corp., which has a molecular weight in the range from 3700-4200 and contains about 3% monostearyl acid phosphate suds suppressor; and also the condensation product of $C_{14-15}$ alcohol with from 5 to 17 moles, particularly 7-9 moles, of ethylene oxide. An example of such a surfactant is commercially available as NEODOL 45-7, available from Shell Chemical Corp., which is the condensation product of $C_{14-15}$ alcohol with 7 moles of ethylene oxide per molecule of alcohol.

In addition to the components described hereinbefore, the detergent compositions which may be used in conjunction with the articles of the present invention can contain additional ingredients which are known to be suitable for use in automatic dishwashing compositions, in the art-established levels for their known functions. Organic and inorganic detergent builder ingredients, alkali materials, sequestering agents, china-protecting agents, reducing agents, hydrotropes, corrosion inhibitors, soil-suspending ingredients, drainage promoting ingredients, enzyme-stabilizing aids, dyes, perfumes, fillers, crystal modifiers and the like represent examples of functional classes of additional automatic dishwashing composition additives.

Suitable inorganic builders include polyphosphates, for example, tripolyphosphate, pyrophosphate, or metaphosphate, carbonates, bicarbonates, and alkali silicates. Particularly preferred are the sodium and potassium salts of the aforementioned inorganic builders. Alkali metal aluminosilicate (Zeolites) such as those of the type disclosed in Belgium Pat. No. 814,552, incorporated herein by reference, can be used. Examples of water-soluble organic builder components include the alkali metal salts of polyacetates, carboxylates, polycarboxylates, and polyhydroxysulfonates. Additional examples include sodium citrate, sodium oxydisuccinate, and sodium mellitate. Normally these builder ingredients can be used in amounts of up to 60%, preferably in the range of from about 10 to 50% by weight.

In order to provide satisfactory pasty compositions, up to about 60% of a solvent, solubilizing material, or suspending agent may be included. Examples of preferred components of this type include polyethylene glycol having a molecular weight of about 400, triethanolamine, methyl esters, $C_{12-13}$ alcohols commercially available as NEODOL 23 alcohols from Shell Chemical Corp., and mixtures thereof. Water may be used in this context and forms the continuous phase of a concentrated dispersion. In many cases, it is desirable to include a viscosity control agent or a thixotropic agent to provide a suitable product form. For example, aqueous solutions or dispersions may be thickened or made thixotropic by the use of conventional agents such as methylcellulose, carboxymethylcellulose, starch, polyvinylpyrrolidone, gelatin, colloidal silica, natural or synthetic clay materials and the like.

The articles of the present invention are made in the following manner. Initially the enzyme, and any other plasticizers or additives to be included, are dispersed and dissolved in the water-soluble resin. The enzyme may be dispersed either uniformly or randomly in the water-soluble resin. However, uniform dispersal of the enzyme is preferred, since this permits a simple way of measuring the amount of enzyme, based on the length of the film used. At this point, it is preferred that the water-soluble, film-forming resin is a viscous liquid in aqueous solution; although organic solvents and melts of the resin may also be used to form the solution. This initial solution of water-soluble resin and enzyme may be made as concentrated or dilute as necessary by normal manufacturing processes. Between about 5 and 90%, more preferably between about 5–75%, most preferably between about 5 and 50% by weight of water may be added to the enzyme resin dispersion, depending on the method used for processing the film. If the enzyme-dispersed film is to be produced by casting, then up to about 50% by weight of water may be added to the initial enzyme resin dispersion. If the enzyme-dispersed film is to be produced via extrusion, then closer to about 5% by weight of water will be preferred in the initial enzyme-resin dispersion.

Casting of the enzyme-dispersed, water-soluble, film-forming resin is accomplished by first pouring the liquid dispersion on a flat surface, then using a roll-down bar to ply the dispersion into sheets of uniform thickness. Extrusion of the enzyme-dispersed, water-soluble, film-forming resin is accomplished by running the liquid dispersion through a series of closely-spaced rollers or a thin orifice to form sheets of uniform thickness. After either casting or extrusion the resulting sheets of enzyme-dispersed, water-soluble film may be air-dried or heat-dried, and then cooled. The dried and cooled sheets may then be cut into ribbons.

The sheets may be cut into ribbons, tapes, wafers, or laminates not more than about 1000 mils thick, preferably not more than about 500 mils thick, more preferably not more than about 250 mils thick, even more preferably not more than about 100 mils thick, and most preferably not more than about 50 mils thick. The ribbons, tapes, wafers, or laminates should have one dimension at least about 3 millimeters in size, preferably at least about 5 millimeters in size, more preferably at least about 10 millimeters in size, even more preferably at least about 15 millimeters in size, and most preferably at least about 20 millimeters in size. The particular size range for the larger dimension is necessary to provide for a nondusting product which will facilitate industrial hygiene in its handling, and also eliminate waste in its preparation. The thinner dimension is necessary for quick dissolution. A product prepared with these dimensions may also be successfully incorporated into a detergent composition, simply, efficiently, and with a minimal amount of waste expenditure. Further, if the detergent product is scrapped, the enzyme films are readily separated from the rest of the formula by screening.

Methylcellulose film is made by casting. Resin, enzyme, and plasticizer are mixed in the desired ratio and then agitated in a tank containing selected solvents for example. The resultant solution of resin, plasticizer, and enzyme is then filtered into a feed tank. This solution is cast into sheets on a stainless steel belt. The film thickness can be controlled simply by regulating the rate at which the solution leaves the hopper, along with the speed of the stainless steel belt. As the water-soluble, enzyme-dispersed film traverses the length of the stainless steel belt, hot air evaporates the water or solvent, which is recovered and recycled. The water-soluble, enzyme-dispersed film is then stripped off the belt, slit to a desired width, and wound onto large rolls.

Polyvinyl alcohol water-soluble films are also made by casting techniques. Film characteristics of these polyvinyl alcohol films are a function of belt speed, viscosity, drying conditions, and formulation among other considerations. Early polyvinyl alcohol films were usually plasticized with glycerin, while later internally-plasticized polyvinyl alcohol films included ethoxylated plasticizers. Considerable work has been done by polyvinyl alcohol film producers to develop extrusion techniques for making these films.

The water-soluble, enzyme-dispersed film-forming resin may be foamed prior to casting or extrusion to increase the solubility of the ultimate film article. Foaming is accomplished by simply whipping up the liquid dispersion in a mixer or similar apparatus prior to casting or extrusion.

A similar product can be prepared by distributing the enzymes and adjunct components on an already formed film and then either forming another film over the enzymes and attaching the second film to the first film or bringing another film into contact with the enzyme-coated film and then sealing, at least in part, to enclose the enzyme and form either a laminate or "packet". The "packet" is desirable for using the least amount of film, but is not as good for recycling scrapped material which has been incorporated into a larger packet with a detergent composition. The device that splits or slits the larger packet may also split or slit the enzyme "packet", thereby releasing all of the enzyme. Slitting the film exposes only a very little, if any, of the enzyme.

The dried and cooled sheets may be coated with a layer of polyvinyl alcohol or other water-soluble resin to form laminates. Preparation of laminates may allow for both control of time release of enzyme into the water solution, and easier handling of the articles. Enzyme release may also be controlled by these structures, so as to occur at the optimal pH and wash-solution conditions. Formation of these laminates may be accomplished also by dipping or printing a layer of water-soluble resin on the newly-dried sheets. The finished sheets may then be cut into ribbons, tapes, wafers, etc., of any number of dimensions, particularly those dimensions recited earlier. This is necessary to control the dusting of the final product, as well as providing for user and industrial hygiene, ease of packaging, and recycling capabilities.

The resultant enzyme-dispersed, water-soluble article may then be incorporated into a detergent product, for example by direct admixing with the surfactant and other detergent components.

In a particularly preferred embodiment of the present invention, the enzyme-containing articles are mixed with an automatic dishwashing detergent composition, and single-use quantities of this composition are sealed in water-soluble packets, such as those described in concurrently filed U.S. patent application Ser. No. 789,325 filed Apr. 20, 1977, incorporated herein by reference. These articles not only provide a convenient way to add detergent to a dishwashing machine, but also provide storage-stability for the enzyme in the alkaline detergent composition, as well as delayed release of the enzyme into the washing solution, so that the wash solution will have attained the pH at which the enzyme exhibits optimum activity, and enzyme-incompatible components, such as phosphates, in the solution will be minimized, prior to the release of the enzyme.

As used herein, the term "water-soluble film" is intended to include those films which are water-dispersible, as well as those which are water-soluble. Each packet may contain a premeasured amount of the detergent composition suitable for a single washing load in an automatic dishwasher, or a convenient fraction of such an amount. It is preferred that the packets contain from about 2 to about 50 grams, most preferably from about 5 to about 25 grams, of the detergent composition. In addition, the packet should be of a convenient size so as to fit, either folded or unfolded, into the detergent dispenser cup of an automatic dishwasher.

A film suitable for use in making packets of the foregoing type must be rapidly and completely soluble or dispersible in hot water ranging in temperature from about 85° F.–150° F., more preferably from about 110° F.–140° F., and particularly about 115° F.–130° F. It must be strong, tough, flexible, shock-resistant and non-tacky during storage at both high and low temperatures and humidity. Very importantly, these properties must be retained by the film while it is in contact with the alkaline detergent compositions used in the present invention. In choosing a film, it is important that the one chosen is compatible with the components of the detergent composition to be contained in the article. This compatibility is particularly important in terms of any solvent used in the detergent composition. For example, where the detergent composition contains water as its solvent, the film chosen must be one which will readily solubilize in the 110°–115° F. dishwasher water, but which will not be solubilized, during storage, by the water in the composition. The film used to make the packets should have a thickness of from about 0.5 to about 5 mils, preferably from about 1 to about 3 mils, and most preferably about 1.5 mils.

It is, furthermore, very desirable that the water-soluble film be readily self-sealable, especially by heat, heat and water, or ultrasonic sealing methods. The sealed portions should dissolve well, along with the remainder of the packets. Preferably, the film should seal completely and permanently at a relatively low temperature and in a short period of time.

Examples of materials useful in making the packets of the present invention include the resins discussed hereinbefore, especially modified starches, methyl and hydroxy propylmethylcellulose derivatives, hydroxyethylcellulose, carboxymethylcellulose, polyvinyl alcohols, such as those described in U.S. Pat. No. 3,413,229, Bianco et al, issued Nov. 26, 1968; U.S. Pat. No. 3,277,009, Freifeld et al, issued Oct. 4, 1966; and U.S. Pat. No. 3,300,546, Baechtold, issued Jan. 24, 1967, all of which are incorporated herein by reference, polyvinylpyrrolidone, and ethylene oxide polymers. These materials are discussed in detail in *Water Soluble Resins*, Davidson and Sittig, Van Nostrand Reinhold Co., 1968, incorporated herein by reference. Preferred materials for making the packets include polyvinyl alcohol, polyethylene oxide, and methylcellulose.

The following nonlimiting examples illustrate the articles of the present invention.

Unless otherwise indicated all percentages, ratios and proportions given in this application are by weight.

EXAMPLE I 100 grams of Monsanto Gelvatol 20-30 polyvinyl alcohol (molecular weight 10,000 and percent hydrolysis 85.5–88.7) was dissolved in 233.3 grams of distilled water. A Waring Blender was used to wet out the polyvinyl alcohol. The mechanical heat of mixing raised the temperature of the mixture to about 130° F. 100 grams of Novo SP-72-Tergitol (enzyme) slurry (1:9 approximate weight proportions of enzyme powder, including small amounts of sodium sulfate and sodium chloride, to surfactant, 8 KNPU/grams proteolytic activity) was then added into the Waring Blender jar as agitation was being maintained. The resulting mixture was allowed to stand for about 20 minutes allowing for deaeration, then poured onto a flat Lucite plate, and spread to a 0.080 inch (80 mils) thickness using a wire-wound rod.

After ice-drying for 24 hours, the film was separated from the Lucite, turned over, and allowed to air dry for an additional four hours. The weight of the mix which was actually delivered onto the Lucite sheet, and the weight of the ultimately-dry film were then determined. The dried film weighed 189.24 grams and had the approximate composition of:

| | |
|---|---|
| Polyvinyl alcohol water-soluble resin | 48.7 wt. % |
| Novo SP72-Tergitol (enzyme) slurry | 48.7 wt. % |
| Water | 2.6 wt. % |

The resulting enzyme-containing film was cut into segments with an area of one square inch (about 1″×1″) and had a thickness of about 80 mils.

Results substantially comparable to those of Example I can also be obtained when the film is cut into ribbons, tapes, wedges, or wafers having one dimension not less than about 3 millimeters, 5 millimeters, 10 millimeters, 15 millimeters, and 20 millimeters in size, and being about 1000 mils, 750 mils, 500 mils, 100 mils, 50 mils, 15 mils and 5 mils thick.

Excellent performance is obtained when polyvinyl alcohol water-soluble, film-forming resin is replaced by cellulose ethers, polyethylene oxide, starch, polyvinylpyrrolidone, polyacrylamide, polyvinylmethylether-maleic anhydride, polymaleic anhydride, and polystyrene-maleic anhydride in comparable weight proportions. Excellent performance is also obtained when the enzyme dispersed in the film-forming resin is an SP-88-Termamyl enzyme mixture (1:1 proportion of protease to amylase, 8 KNPU/gram proteolytic activity and 8 KNU/gram amylolytic activity) in comparable weight percentages to Example I.

When the plasticizers such as glycols, glycerol, sorbitol, triethanolamine and urea are incorporated into the above films from about 10% to about 30% by weight, improved handling and elongation characteristics of the above film are obtained.

Addition of solid extenders, such as granular starch, urea, and sodium sulfate in amounts about 30% by weight permits the production of a less expensive film which exhibits excellent physical and handling characteristics and is more quickly soluble.

EXAMPLE II

In order to evaluate the effect the urea level has on the solubility of the enzyme-dispersed, water-soluble film, three articles were prepared:

| Article A | |
|---|---|
| Water | 125 grams |
| Urea | 25 grams |
| Gelvatol 30–30 polyvinyl alcohol (blender-ground through "40" Tyler mesh) | 50 grams |
| Novo SP88-Tergitol slurry | 58 grams |
| | 258 grams |

The above mixture was run in the Osterizer Blender until the temperature reached 150° F. in order to be certain that the Gelvatol was well dispersed. The films were cast using a 40 mil wire-wound rod. The thickness of the film of this particular example ranged from 0.014 inches to 0.020 inches (14–20 mils) and the composition was (in weight percent):

| | % by Wt. |
|---|---|
| Water | 5.0 |
| Urea | 17.9 |
| Gelvatol 30–30 polyvinyl alcohol (molecular weight 10,000 and percent hydrolysis 79.9–84.1, blender-ground through "40" Tyler mesh) | 35.7 |
| Novo SP88-Tergitol slurry (1:9 enzyme:surfactant) | 41.4 |
| | 100.0 |

0.45 gram (dimensions about 1"×1") of this final film composition was placed in a 3500 ml beaker containing 120° F. water, and was then agitated. Approximately 90% by weight of this sample dissolved in the 120° F. water within 1 minute 20 seconds.

| Article B | |
|---|---|
| Water | 125 grams |
| Gelvatol 20–30 polyvinyl alcohol (blender-ground through "40" Tyler mesh) | 50 grams |
| Novo SP88-Tergitol slurry | 58 grams |

-continued

| Article B | |
|---|---|
| | 233 grams |

The above mixture was a thick gel with some "water phase" evident. Since this batch was gelled, the film was cast using a "tapping" method. Unlike conventional casting where the wire-wound rod is pulled slowly in a single direction, this particular film was made using the same rods but with a vertical motion, "tapping" the rod down into the Plexiglass to limit the amount of wire winding. This action was continued as the wire-wound rod was moved slowly in the film-casting direction. The composition of this film, in weight percent, was as follows:

| | |
|---|---|
| Water | 5.0% |
| Gelvatol 20–30 polyvinyl alcohol | 44.0% |
| Novo SP88-Tergitol slurry | 51.0% |
| | 100.0% |

A piece of this film, about 1" square and 15 mils thick, was tested for solubility under automatic dishwasher washing conditions. 0.45 grams of this final film composition was placed in a 3500 ml beaker containing 120° F. water, and was then agitated. Approximately 90% by weight of this sample dissolved in the 120° F. water within three minutes, 20 seconds.

| Article C | |
|---|---|
| Water | 125 grams |
| Urea | 50 grams |
| Gelvatol 30–30 polyvinyl alcohol (blender-ground through "40" Tyler mesh) | 50 grams |
| Novo SP88-Tergitol slurry | 58 grams |
| | 233 grams |

This particular composition had a lot of foam which resisted vacuum de-aeration. Therefore, this mixture was allowed to stand overnight to de-aerate. After production via normal casting techniques, the thickness of this film ranged from 0.014 to 0.016 inches, and its composition was:

| | |
|---|---|
| Water | 5.0% |
| Urea | 30.0% |
| Gelvatol 30–30 polyvinyl alcohol | 30.0% |
| Novo SP88-Tergitol slurry | 35.0% |
| | 100.0% |

0.45 grams of this film (about 1" square) was placed in a 3500 ml beaker containing 120° F. water, and was agitated, simulating automatic dishwasher washing conditions. Roughly 90% by weight of this sample dissolved within 40 seconds and 100% by weight of this sample dissolved within one minute, ten seconds. A dimethyl casein (DMC) analysis was performed on Article C which resulted in a proteolytic activity of 0.57 Anson Units (AU)/grams.

It should be noted that all three compositional films, A, B, and C, contained small particles of undissolved Gelvatol.

Excellent performance is obtained when the polyvinyl alcohol water-soluble, film-forming resin is replaced by cellulose ethers, polyethylene oxide, starch, polyvinylpyrrolidone, polyacrylamide, polyvinylmethylether-maleic anhydride, polymaleic anhydride, and polystyrene-maleic anhydride in comparable weight proportions. Excellent performance is also obtained when SP88-Termamyl enzyme mixture (1:1 proportions of protease to amylase), or a mixture of amylolytic to proteolytic enzyme from 4:1 to 1:4 ratios by weight, are dispersed in the water-soluble resin film in comparable proportions to Example II.

Plasticizers such as glycols, glycerol, sorbitol, and triethanolamine may be used in the above three compositions in weight percents of from about 10% to about 30% with excellent results.

Solid extenders such as granular starch, and sodium sulfate may be included in weight percents from about 10% to about 40%, preferably from about 20% to about 30% in the above three compositions.

Suds regulating agents, such as self-emulsifying silicone suds suppressors, microcrystalline waxes, and alkyl phosphate esters may be successfully incorporated into resin films of the above three articles, A, B, and C, in amounts between 0.1% and 1% by weight. Surfactants, particularly alkoxylated nonionic surfactants, such as the condensation product of tallow alcohol with from about 6 to 20, particularly about 9, moles of ethylene oxide, and the condensation product of $C_{14-15}$ alcohol with from about 5 to 17, particularly about 7 to 9, moles of ethylene oxide may be successfully incorporated into the three resin films of Example II.

EXAMPLE III

Two compositions of the present invention are prepared as follows:

| Composition | Comp. A | Comp. B |
|---|---|---|
| Water | 125 g. | 125 g. |
| Polyvinyl alcohol (Gelvatol) 20-30 | 50 g. | 50 g. |
| Glycerin | 50 g. | 50 g. |
| Dextrin | 3 g. | — |
| Urea | — | 3 g. |
| SP88-Termamyl mixture (1:1 by weight, 8 KNPU/gram proteolytic activity) | 50 g. | 50 g. |

These materials are blended at room temperature, then heated to approximately 150° F. to dissolve all solid materials. They are then poured onto a sheet of Plexiglass and drawn into sheets using a metal rod with various size wires, wound around near the ends. The sheets are then allowed to air-dry overnight. The next day the sheets are removed and their thicknesses measured:

| Composition | Comp. A | Comp. B |
|---|---|---|
| 0.022" wire-wound rod | 0.012" | 0.012" |
| 0.040" wire-wound rod | 0.016 41 | 0.016" |
| 0.080" wire-wound rod | 0.025" | 0.025" |

The film was then cut into square articles 3 millimeters, 5 millimeters, 10 millimeters, 15 millimeters, 20 millimeters, and 25 millimeters on a side.

EXAMPLE IV

A detergent composition for use in automatic dishwashers is formulated in the following manner. The composition of Example I is cut into articles about 0.75" square and about 0.2 grams of the articles are combined with about 24 grams of granular detergent composition having the following formulation:

| Component | % by Wt. |
|---|---|
| Ethylene oxide/propylene oxide condensate of trimethylol propane ("Pluradot HA-433" Wyandotte) | 10.00 |
| Monostearyl acid phosphate (Contained in "Pluradot HA-433" Wyandotte) | 0.30 |
| Sodium cumene sulfonate | 10.00 |
| Sodium carbonate | 20.00 |
| Sodium bicarbonate | 10.00 |
| Silicate solids ratio: $SiO_2$:$Na_2O$=2.0 | 20.00 |
| $(NaPO_3)_{21}$ | 2.00 |
| Sodium sulfate | Balance to 100% |

EXAMPLE V

Detergent articles for use in automatic dishwashers are formulated in the following manner. About 24 grams of the composition of Example III are heat-sealed in a ten-centimeter-square packet made out of a medium hydrolysis polyvinyl alcohol film, commercially available from Monosol, having a thickness of about 1.5 mils.

About 24 grams of the composition of Example III is heat-sealed in a ten-centimeter-square packet made out of Edisol-M, a methylcellulose film, having a thickness of about 1.5 mils, commercially available from Polymer Films, Inc.

EXAMPLE VI

A detergent composition for use in automatic dishwashers is made in the following manner. The composition of Example I is cut into articles having the dimensions 10 mm×25 mm and these articles are combined with the following granular detergent composition in a ratio of 1 part of the water-soluble articles to about 100 parts of the detergent composition.

| Component | % by Wt. |
|---|---|
| Ethylene oxide/propylene oxide condensate of trimethylol propane | 9.7 |
| Sodium cumene sulfonate | 10.0 |
| Monostearyl acid phosphate | 0.3 |
| $(NaPO_3)_{21}$, sodium polymetaphosphate | 2.0 |
| 2.0 ratio sodium silicate solids | 20.0 |
| Sodium carbonate | 20.0 |
| Sodium bicarbonate | 10.0 |
| Sodium sulfate | 27.5 |
| Moisture, perfume, dyes, etc. | Balance to 100% |

EXAMPLE VII

About 24 grams of the composition of Example VII is sealed in a 4 square-inch water-soluble packet made of polyvinyl alcohol film, having a thickness of 2.5 mils. The detergent article exhibits good dispensing, cleaning and dissolution properties when used in an automatic dishwasher.

EXAMPLE VIII

A detergent composition for use in automatic dishwashers is made in the following manner. The composition of Article C of Example II are cut into articles having dimensions of 20 mm × 15 mm, and these articles are combined with the following granular detergent composition in a ratio of about 1 part of the articles to about 75 parts of the detergent composition.

| Component | % by Weight |
|---|---|
| Ethylene oxide/propylene oxide condensate of trimethylol propane | 4.85 |
| Sodium cumene sulfonate | 5.0 |
| Monostearyl acid phosphate | 0.15 |
| Sodium tripolyphosphate | 45.0 |
| Trisodium phosphate | 22.0 |
| 2.0 ratio sodium silicate solids | 20.0 |
| Sodium sulfate | balance to 100% |

When the article is placed in 100° F. wash water with agitation, it is found to substantially completely dissolve within about one minute.

EXAMPLE IX

About 15 grams of the composition of Example VIII is placed in a water-soluble packet made of polyethylene oxide film having a thickness of 1.5 mils. The packet is sealed ultrasonically. The detergent article is placed in the detergent dispenser cup of an automatic dishwasher, and dirty dishes and tableware are washed with it. The dishes and tableware are clean after the completion of the dishwasher cycle, and there is no residue of the paste or the packet remaining in the dispenser cup or on the inside of the dishwasher.

EXAMPLE X

The composition of Article C Example III is be cut into articles having dimensions of about 25 mm square, and these articles are combined with the following granular detergent composition in a ratio of about 1 part of the articles to about 50 parts of the detergent composition. The composition prepared may be used in an automatic dishwasher.

| Component | % by Wt. |
|---|---|
| Ethylene oxide/propylene oxide condensate of trimethylol propane | 9.7 |
| Sodium cumene sulfonate | 9.0 |
| Monostearyl acid phosphate | 0.3 |
| Sodium carbonate | 10.0 |
| Sodium nitrilotriacetate | 50.0 |
| 2.0 ratio sodium silicate | 20.0 |
| Sodium sulfate | balance to 100 |

EXAMPLE XI

About 12 grams of the composition of Example XI is placed in a water-soluble packet made of a low hydrolysis, polyvinyl alcohol film, commercially available as Monosol 9000-0015-3, having a thickness of about 1.5 mils. The packet is heat-sealed. This detergent article exhibits good cleaning, dispensing and solubilizing properties when used in an automatic dishwasher.

EXAMPLE XII

Detergent compositions for use in automatic dishwashers are made in the following manner. The composition of Article A of Example II is cut into articles having dimensions of about 12 mm square, and these articles are combined with the following detergent compositions in a ratio of about 1 part of the articles to about 50 parts of the detergent composition.

| Component | % by Wt. |
|---|---|
| Condensation product of one mole tallow alcohol and 9 moles of ethylene oxide | 5.0 |
| Sodium cumene sulfate | 8.0 |
| Monostearyl acid phosphate | 0.8 |
| $(NaPO_3)_{21}$ | 2.0 |
| Sodium carbonate | 20.0 |
| Sodium bicarbonate | 10.0 |
| 2.0 ratio sodium silicate solids | 20.0 |
| Sodium sulfate | balance to 100 |

EXAMPLE XIII

Each of the paste-form detergent mixtures of Example XII (about 10 grams of each) is sealed in separate water-soluble packets made of Edisol M, a methylcellulose film, having a thickness of about 1.5 mils, commercially available from Polymer Films, Inc. The packets are heat-sealed. Each of these detergent articles exhibits good cleaning, dispensing and solubilization properties when placed in the detergent dispenser cup and used in an automatic dishwasher.

EXAMPLE XIV

About 0.2 gram of Novo SP72-Tergitol slurry (8.0 KNPU/-gram) is heat-sealed within a one-centimeter-square packet made out of a medium hydrolysis polyvinyl alcohol film, commercially available from Monosol, having a thickness of about 1.5 mils.

| Component | % by Wt. |
|---|---|
| Ethylene oxide/propylene oxide condensate of trimethylol propane | 2.5 |
| Condensation product of one mole tallow alcohol and 9 moles ethylene oxide | 2.5 |
| Sodium cumene sulfonate | 5.0 |
| Monostearyl acid phosphate | 0.08 |
| $(NaPO_3)_{21}$ | 2.0 |
| Sodium carbonate | 20.0 |
| Sodium bicarbonate | 10.0 |
| 2.0 ratio sodium silicate | 20.0 |
| Sodium sulfate | balance to 100 |

About 12 grams of the above detergent composition together with the enzyme-containing packet is heat-sealed in a five-centimeter-square packet made out of Edisol-M, a methylcellulose film, having a thickness of about 1.5 mils, commercially available from Polymer Films, Inc.

This detergent article is convenient to handle and use, and provides excellent cleaning of cookware and tableware when used in an automatic dishwasher.

EXAMPLE XV

About 0.2 gram of SP88-Termamyl enzyme mixture (1:1 by weight) is heat-sealed in a one-centimeter-square water-soluble packet made of polyvinyl alcohol film, having a thickness of 2.5 mils.

| Component | % by Wt. |
|---|---|
| Ethylene oxide/propylene oxide condensate of trimethylol propane | 10.0 |

-continued

| Component | % by Wt. |
|---|---|
| Potassium toluene sulfonate | 10.0 |
| Monostearyl acid phosphate | 0.3 |
| Sodium tripolyphosphate | 25.0 |
| 2.0 ratio sodium silicate | 20.0 |
| Sodium sulfate | balance to 100 |

About 15 grams of the above detergent composition, together with the enzyme-containing packet, is placed in a water-soluble packet made of polyethylene oxide film having a thickness of 1.5 mils. The packet is sealed ultrasonically. This article provides excellent cleaning performance when used in an automatic dishwasher.

EXAMPLE XVI

The enzyme-containing detergent composition of Example XV is sealed in a five-centimeter-square polyvinyl alcohol film having a thickness of 2.5 mils. This article provides excellent cleaning performance when used in an automatic dishwasher.

EXAMPLE XVII

A detergent composition for use in automatic dishwashers is formulated in the following manner. The composition of Example I is cut into articles about 0.75" square and about 0.2 g of the articles are combined with about 24 g of a paste detergent composition having the following formulation:

| Component | % by Weight |
|---|---|
| Sodium tripolyphosphate | 35.69 |
| Sodium silicate solids (4:1 ratio by weight of 2.4 ratio: 2.0 ratio) | 17.49 |
| $SiO_2$ | 12.24 |
| Water | 8.74 |
| Neodol 45-7 (condensation product of one mole of $C_{14-15}$ alcohol with 7 moles of ethylene oxide) | 4.32 |
| Triethanolamine | 19.54 |
| SAG-100 (polydimethylsiloxane suds suppressor, commercially available from Dow Corning) | 0.70 |
| Dye and perfume | balance to 100 |

EXAMPLE XVIII

Detergent articles for use in automatic dishwashers are formulated in the following manner. About 12 grams of the composition of Example XVII are heat-sealed in a ten-centimeter-square packet made out of a low hydrolysis polyvinyl alcohol film, commercially available as Monosol 9000-0015-3, having a thickness of about 1.5 mils.

About 12 grams of the composition of Example III is heat-sealed in a five-centimeter-square packet made out of Edisol-M, a methylcellulose film, having a thickness of about 1.5 mils, commercially available from Polymer Films, Inc.

EXAMPLE XIX

A detergent composition for use in automatic dishwashers is made in the following manner. The composition of Example I is cut into articles having the dimensions 10 mm×25 mm and these articles are combined with the following paste detergent composition in a ratio of 1 part of the water-soluble articles to about 100 parts of the detergent composition.

| Component | % by Weight |
|---|---|
| Neodol 45-7 | 5.87 |
| DB-544 (self-emulsifying silicone suds suppressor commercially available from Dow Corning) | 0.81 |
| Sodium silicate solids (2.0 ratio) | 14.17 |
| Triethanolamine | 27.33 |
| Anhydrous sodium tripolyphosphate | 35.42 |
| Water and minors | balance to 100 |

EXAMPLE XX

About 12 grams of the composition of Example XIX are sealed in a water-soluble packet made of polyvinyl alcohol film, having a thickness of 2.5 mils. The detergent article exhibits good dispensing, cleaning and dissolution properties when used in an automatic dishwasher.

EXAMPLE XXI

The composition of Article C of Example III is cut into articles having dimensions of about 25 mm square, and these articles are combined with the following gel detergent composition in a ratio of about 1 part of the articles to about 100 parts of the detergent composition. The composition prepared may be used in an automatic dishwasher.

| Component | % by Weight |
|---|---|
| Condensation product of tallow alcohol with about 9 moles of ethylene oxide | 8.00 |
| 2.0 ratio sodium silicate solids | 32.39 |
| Sodium tripolyphosphate | 20.04 |
| Water and moisture | balance to 100 |

EXAMPLE XXII

About 12 grams of the composition of Example XXI is placed in a water-soluble packet made of a low hydrolysis, polyvinyl alcohol film, commercially available as Monosol 9000-0015-3, having a thickness of about 1.5 mils. The packet is heat-sealed. This detergent article exhibits good cleaning, dispensing and solubilizing properties when used in an automatic dishwasher.

EXAMPLE XXIII

A detergent composition for use in automatic dishwashers is made in the following manner. The composition of Article A of Example II is cut into articles having dimensions of 20 mm×15 mm and these articles are combined with the following granular detergent composition in a ratio of about 1 part of the articles to about 20 parts of the detergent composition.

| Component | % by Weight |
|---|---|
| Sodium tripolyphosphate | 20.44 |
| 3.2 ratio sodium silicate solids | 4.47 |
| Sodium sulfate | 34.07 |
| Sodium carbonate | 27.26 |
| Triethanolamine | 5.25 |
| DB-544 | 1.06 |
| Water | 7.46 |

-continued

| Component | % by Weight |
|---|---|
| | 100.00 |

EXAMPLE XIV

Detergent articles for use in automatic dishwashers are formulated in the following manner. About 12 grams of a composition of Example XXIII are heat-sealed in a 2"×2" square packet made out of low hydrolysis polyvinyl alcohol film commercially available as Monosol 9000-0015-3, having a thickness of about 1.5 mils.

EXAMPLE XXV

A detergent composition for use in automatic dishwashers is made in the following manner. The composition of Article B of Example II is cut into articles having dimensions of 20 mm×15 mm and these articles are combined with the following granular detergent composition in a ratio of about 1 part of the articles to about 30 parts of the detergent composition.

| Component | % by Weight |
|---|---|
| Sodium tripolyphosphate | 20.44 |
| 3.2 ratio sodium silicate solids | 4.47 |
| Triethanolamine | 5.25 |
| DB-44 | 1.06 |
| Sodium sesquicarbonate | 61.32 |
| Water | 7.46 |
| | 100.00 |

EXAMPLE XXVI

About 12 grams of a composition of Example XXV is placed in a water-soluble packet made of polyethylene oxide films having a thickness of 1.5 mils and 2"×2" square dimensions. The packet is sealed ultrasonically.

EXAMPLE XXVII

A detergent composition for use in automatic dishwashers is made in the following manner. The composition of Article C of Example II is cut into articles having dimensions of 20 mm×15 mm, and these articles are combined with the following granular detergent composition in a ratio of about 1 part of the articles to about 30 parts of the detergent composition.

| Component | % by Weight |
|---|---|
| Sodium tripolyphosphate | 40.26 |
| 2.0 ratio sodium silicate solid | 44.73 |
| Water | 15.01 |

EXAMPLE XXVIII

About 12 grams of a composition of Example XXVII is placed in a water-soluble packet made of a low hydrolysis polyvinyl alcohol film, commercially available as Monosol 9000-0015-3, having a thickness of about 1.5 mils and a 2" square dimensions. The packet is heat-sealed.

The composition of Example XXVII may also be heat-sealed in a separate water-soluble packet made of Edisol-M, a methylcellulose film, having a thickness of about 1.5 mils, 2" square dimensions, commercially available from Polymer Films, Inc. About 12 grams of the composition of Example XXVII are heatsealed in this manner.

EXAMPLE XXIX

A laundry detergent composition of the present invention is made in the following manner. The composition of Example I is cut into articles having dimensions 20 mm ×15 mm, and these articles are combined with the following granular laundry detergent composition in a ratio of about 1 part of the articles to about 100 parts of the detergent composition.

| Component | % by Weight |
|---|---|
| Sodium $C_{11.8}$ linear alkyl benzene sulfonate | 13.5 |
| Condensation product of $C_{14-15}$ alcohol with 7 moles of ethylene oxide (Neodol 45-7) | 4.5 |
| Sodium tripolyphosphate | 24.4 |
| Sodium sulfate | 36.5 |
| 2.4 ratio sodium silicate | 12.0 |
| Moisture and minors | balance to 100 |

EXAMPLE XXX

Laundry detergent articles are formulated in the following manner. About 12 grams of the composition of Example XXIX are heat-sealed in a five-centimeter-square packet made out a low hydrolysis polyvinyl alcohol film, commercially available as Monosol 9000-0015-3, having a thickness of about 1.5 mils.

About 12 grams of a composition of Example XXIX is heat-sealed in a five-centimeter-square packet made out of Edisol-M, a methylcellulose film, having a thickness of about 1.5 mils, commercially available from Polymer Films, Inc.

What is claimed is:

1. A granular detergent composition comprising from about 1% to about 40% of a surface-active agent selected from the group consisting of water-soluble anionic, nonionic, ampholytic and zwitterionic surface-active agents and mixtures thereof and from about 10% to about 60% of a detergent builder selected from the group consisting of sodium and potassium polyphosphates, carbonates, bicarbonates, silicates, polyacetates, carboxylates, polycarboxylates and polyhydroxysulfonates and containing a nondusting article, said article comprising an enzyme selected from the group consisting of proteolytic enzymes, amylolytic enzymes and mixtures thereof dispersed in a water-soluble resin film, said resin selected from the group consisting of polyvinyl alcohol, cellulose ethers, polyethylene oxide, starch, polyvinylpyrrolidone, polyacrylamide, polyvinylmethylethermaleic anhydride, polymaleic anhydride, polystyrene-maleic anhydride and mixtures thereof, wherein one dimension of said article is at least about 20 millimeters in size and the thickness of said article is not more than about 50 mils.

2. The granular detergent composition of claim 1 wherein said nondusting article is substantially completely dissolved in 130° F. water with agitation within about five minutes.

3. The granular detergent composition of claim 1 wherein said nondusting article is substantially completely dissolved in 100° F. water with agitation within about three minutes.

4. The granular detergent composition of claim 1 wherein said nondusting article is substantially completely dissolved in 100° F. water with agitation within about one minute.

5. The granular detergent composition of claim 1 wherein said nondusting article is foamed.

6. The granular detergent composition of claim 1 wherein said nondusting article is produced by extrusion followed by drying and cooling.

7. The granular detergent composition of claim 1 wherein said nondusting article is produced by casting followed by drying and cooling.

8. The granular detergent composition of claim 1 wherein said resin is methyl cellulose.

9. The granular detergent composition of claim 1 wherein said resin is polyvinyl alcohol.

10. The granular detergent composition of claim 1 wherein said resin is polyethylene oxide.

11. The granular detergent composition of claim 1 wherein said nondusting article contains a proteolytic enzyme.

12. The granular detergent composition of claim 1 wherein said nondusting article contains an amylolytic enzyme.

13. The granular detergent composition of claim 11 wherein the proteolytic enzyme exhibits 80–100% of maximum activity when measured at pH 12 using the Anson Hemoglobin Method carried out in the presence of urea.

14. The granular detergent composition of claim 13 which additionally contains an amylolytic enzyme.

15. The granular detergent composition of claim 12 wherein the amylolytic enzyme exhibits an amylolytic activity of greater than 50% of maximum when measured by the SKB method at 37° C.

16. The granular detergent composition of claim 13 wherein the amylolytic enzyme exhibits an amylolytic activity of greater than 50% of maximum when measured by the SKB method at 37° C.

17. The granular detergent composition of claim 1 wherein the nondusting article additionally contains up to about 80% by weight of a plasticizer.

18. The granular detergent composition of claim 17, wherein the nondusting article additionally contains from about 10% to about 50% by weight of a plasticizer.

19. The granular detergent composition of claim 18 wherein the nondusting article additionally contains from about 10% to about 30% by weight of a plasticizer.

20. The granular detergent composition of claim 18 wherein the plasticizer is selected from the group consisting of glycols, glycerol, sorbitol, triethanolamine, and mixtures thereof.

21. The detergent composition of claim 20 wherein the resin is polyvinyl alcohol.

22. The granular detergent composition of claim 21 wherein the polyvinyl alcohol has an average molecular weight of from about 1,000 to 300,000.

23. The detergent composition of claim 1 wherein the nondusting article additionally contains from about 10% to about 40% by weight of a solid extender component selected from the group consisting of granular starch, dextrin, sodium sulfate, and mixtures thereof, dispersed within said article.

24. The detergent composition of claim 1 wherein the nondusting article additionally contains a surface-active component.

25. The detergent composition of claim 1 wherein the nondusting article additionally contains a suds-modifying component.

26. The detergent composition of claim 1 wherein the nondusting article is additionally coated with a water-soluble resin forming a laminate.

27. The detergent composition of claim 26 wherein the nondusting article is additionally coated with polyvinyl alcohol resin forming a laminate.

* * * * *